US012392098B2

(12) United States Patent
Smolley

(10) Patent No.: US 12,392,098 B2
(45) **Date of Patent: *Aug. 19, 2025**

(54) ANIMAL WASTE COLLECTING ASSEMBLY AND METHOD

(71) Applicant: John Smolley, Maple Grove, MN (US)

(72) Inventor: John Smolley, Maple Grove, MN (US)

( * ) Notice: Subject to any disclaimer, the term of this patent is extended or adjusted under 35 U.S.C. 154(b) by 598 days.

This patent is subject to a terminal disclaimer.

(21) Appl. No.: 17/881,248

(22) Filed: Aug. 4, 2022

(65) Prior Publication Data

US 2022/0372719 A1 Nov. 24, 2022

Related U.S. Application Data

(63) Continuation-in-part of application No. 16/662,727, filed on Oct. 24, 2019, now Pat. No. 11,441,280.

(51) Int. Cl.
*E01H 1/12* (2006.01)

(52) U.S. Cl.
CPC ..... *E01H 1/1206* (2013.01)

(58) Field of Classification Search
CPC ..... E01H 1/1206; E01H 2001/1293
See application file for complete search history.

(56) References Cited

U.S. PATENT DOCUMENTS

| | | | | |
|---|---|---|---|---|
| 3,688,483 | A | 9/1972 | Hamilton | |
| 4,138,153 | A | 2/1979 | Brown | |
| 8,146,967 | B1 | 4/2012 | Brown | |
| 8,684,429 | B1 | 4/2014 | Holub | |
| 9,072,280 | B1 | 7/2015 | Ramouler | |
| 9,347,192 | B1 | 5/2016 | Smith | |
| 9,756,836 | B2 | 9/2017 | Coba | |
| 9,999,200 | B1 | 6/2018 | Desimone | |
| 10,006,180 | B2 | 6/2018 | Weber | |
| 10,024,011 | B2 | 7/2018 | Griffin | |
| 11,441,280 | B2 * | 9/2022 | Smolley | E01H 1/1206 |
| 2004/0164568 | A1 | 8/2004 | Diehl | |
| 2009/0072559 | A1 | 3/2009 | Wilkerson | |

* cited by examiner

*Primary Examiner* — Stephen A Vu

(57) ABSTRACT

An animal waste collecting assembly includes a pole defining a handle. The pole is elongated and has a first end and a second end. A frame releasably engages and supports a plastic bag and includes a closed loop attached to and extending away from the second end of the pole. The closed loop has an end member positioned opposite of the pole. The end member is linear for a distance greater than 4.0 inches and is orientated perpendicular to a longitudinal axis of the pole. A plurality of tines is attached to and extends away from the end member. The tines are co-planar with respect to each other and lie in a plane angled back toward the pole. A clip is mounted on the pole adjacent to the second end. The clip releasably secures an edge of the plastic bag to the pole.

11 Claims, 13 Drawing Sheets

ANIMAL WASTE COLLECTING ASSEMBLY AND METHOD

CROSS-REFERENCE TO RELATED APPLICATIONS

This is a continuation in part and I hereby claim the benefit under 35 U.S.C., Section 120 of U.S. application Ser. No. 16/662,727 filed on Oct. 24, 2019.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to animal waste collector and more particularly pertains to a new animal waste collector for effectively retrieving animal waste out of grass in such a manner that the animal waste is not pushed into the grass and the animal waste is securely contained.

(2) Description of Related Art Including Information Disclosed Under 37 CFR 1.97 and 1.98

The prior art relates to animal waste collectors in general and more particularly animal waste scooping devices for capturing animal waste within a disposable bag.

BRIEF SUMMARY OF THE INVENTION

An embodiment of the disclosure meets the needs presented above by generally comprising a pole defining a handle. The pole is elongated and has a first end and a second end. A frame releasably engages and supports a plastic bag and includes a closed loop attached to and extending away from the second end of the pole. The closed loop has an end member positioned opposite of the pole. The end member is linear for a distance greater than 4.0 inches and is orientated perpendicular to a longitudinal axis of the pole. A plurality of tines is attached to and extends away from the end member. The tines are co-planar with respect to each other and lie in a plane angled back toward the pole.

A clip is mounted on the pole adjacent to the second end and releasably secures an edge of the plastic bag adjacent to the pole.

Another embodiment of the disclosure teaches a pole defining a handle which is elongated and has a first end and a second end. A frame configured to releasably engage and support a plastic bag includes a closed loop that is attached to and extends away from the second end of the pole. The closed loop has an end member positioned opposite of the pole. The end member is linear for a distance greater than 4.0 inches and is orientated perpendicular to a longitudinal axis of the pole. A plurality of tines is attached to and extends away from the end member. The tines are co-planar with respect to each other and lie in a same plane. An engagement member is mounted adjacent to the second end of the pole and is configured to releasably secure the plastic bag adjacent to the pole to retain the plastic bag in an open configuration. A receiver includes a bottom surface having a plurality of wells extending therein. The wells are aligned with each other and positioned such that each of the tines is simultaneously extendable into one of the wells. The receiver is configured to be urged against the plastic bag positioned between the tines and the receiver such that the tines impale the plastic bag.

In another embodiment the disclosure teaches a method of positioning a plastic bag adjacent to a frame attached to a pole. The pole has a first end and a second end. The frame is positioned adjacent to the second end and includes a closed loop attached to and extending away from the second end of the pole. The closed loop has an end member positioned opposite of the pole that is linear for a distance greater than 4.0 inches and is orientated perpendicular to a longitudinal axis of the pole. A plurality of tines is attached to and extends away from the end member. The tines are co-planar with respect to each other and lay a plane angled back toward the pole. The tines are urged through the plastic bag at a location adjacent to a perimeter edge of the plastic bag. The bag is extended through the closed loop and an opposite edge of the bag relative to the tines is secured to the pole with a clip mounted on the pole adjacent to the second end. The clip is configured to releasably secure an edge of the plastic bag to the pole. A pair of spikes is extended through the bag. The spikes are attached to the frame and are positioned on opposite sides of the longitudinal axis with respect to each other. The spikes extend toward the pole. The tines are moved across a ground surface to engage and capture animal waste positioned on the ground surface such that the animal waste moves into the plastic bag.

In yet another embodiment, the disclosure teaches a method of colleting animal waste including positioning a plastic bag on a frame attached to the pole and securing the plastic bag to the frame. The steps of securing the plastic bag on the frame includes extending a plurality of tines of the frame through the plastic bag adjacent to a perimeter edge of the plastic bag. The tines are co-planar with each other and positioned on an end member distal to the pole. An opposite edge of the plastic bag relative to the tines is attached to the frame proximate to the pole with an engagement member. The plastic bag is extended through a closed loop formed by the frame rearward of the tines and engagement member such that plastic bag remains in an open configuration between the engagement member the tines. The tines are moved across a ground surface to engage and capture animal waste positioned on the ground surface such that the animal waste moves into the plastic bag. The plastic bag is thereafter removed from the frame and discarded.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
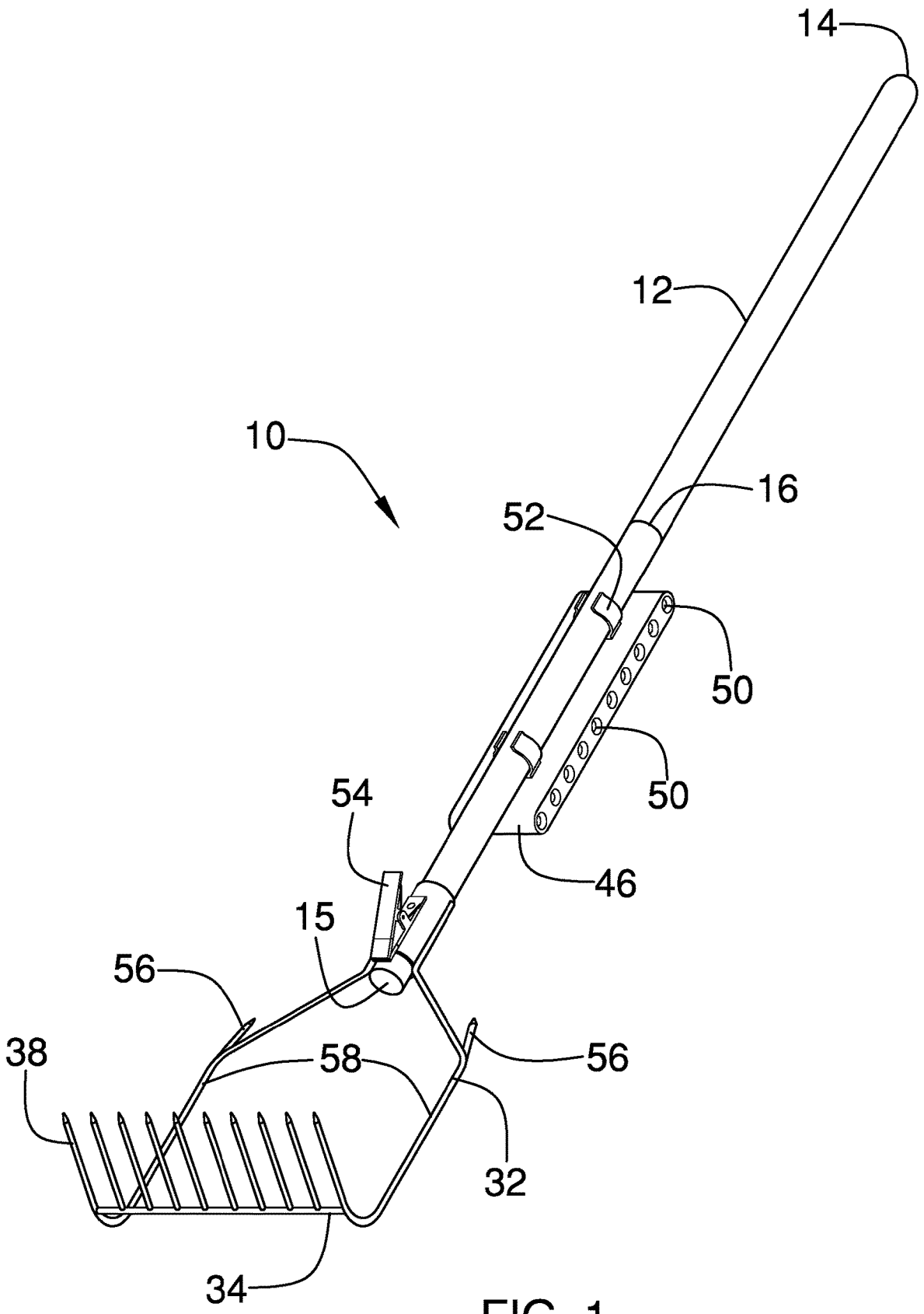
FIG. 1 is a front isometric view of a animal waste collecting assembly and method according to an embodiment of the disclosure.

With reference now to the drawings, and in particular to FIGS. 1 through 18 thereof, a new animal waste collector embodying the principles and concepts of an embodiment of the disclosure and generally designated by the reference numeral 10 will be described.

As best illustrated in FIGS. 1 through 18, the animal waste collecting assembly 10 and method generally comprises a pole 12 that defines a handle. The pole 12 is elongated and has a first end 14 and a second end 15 with a length typically between 3.0 feet and 6.0 feet. For storage and transportation purposes, the pole 12 may have a break 16 therein to form a first portion 18 and a second portion 20 of the pole 12. The first 18 and second 20 portions are removably attached to each other. This may be achieved, for example, with a threaded male mating member 22 on the first portion 18 being threadably engaged with a female mating member 24 extending into the second portion 20. Alternatively, the pole 12 may be telescopic such that it has an adjustable length in a conventional manner.

A frame 26 is configured to releasably engage and support a plastic bag 28. The plastic bag 28 may be of the type typically used for grocery shopping and include a pair of handles 30. The frame 26 includes a closed loop 32 that is attached to and extends away from the second end 15 of the pole 12. The closed loop 32 has an end member 34 positioned opposite of the pole 12. The end member 34 is linear for a distance greater than 4.0 inches and is orientated perpendicular to a longitudinal axis 36 of the pole 12. The closed loop 32 may be formed by portions of the pole 12 or a coupler engaging the pole 12 and frame 26.

Figure 8:
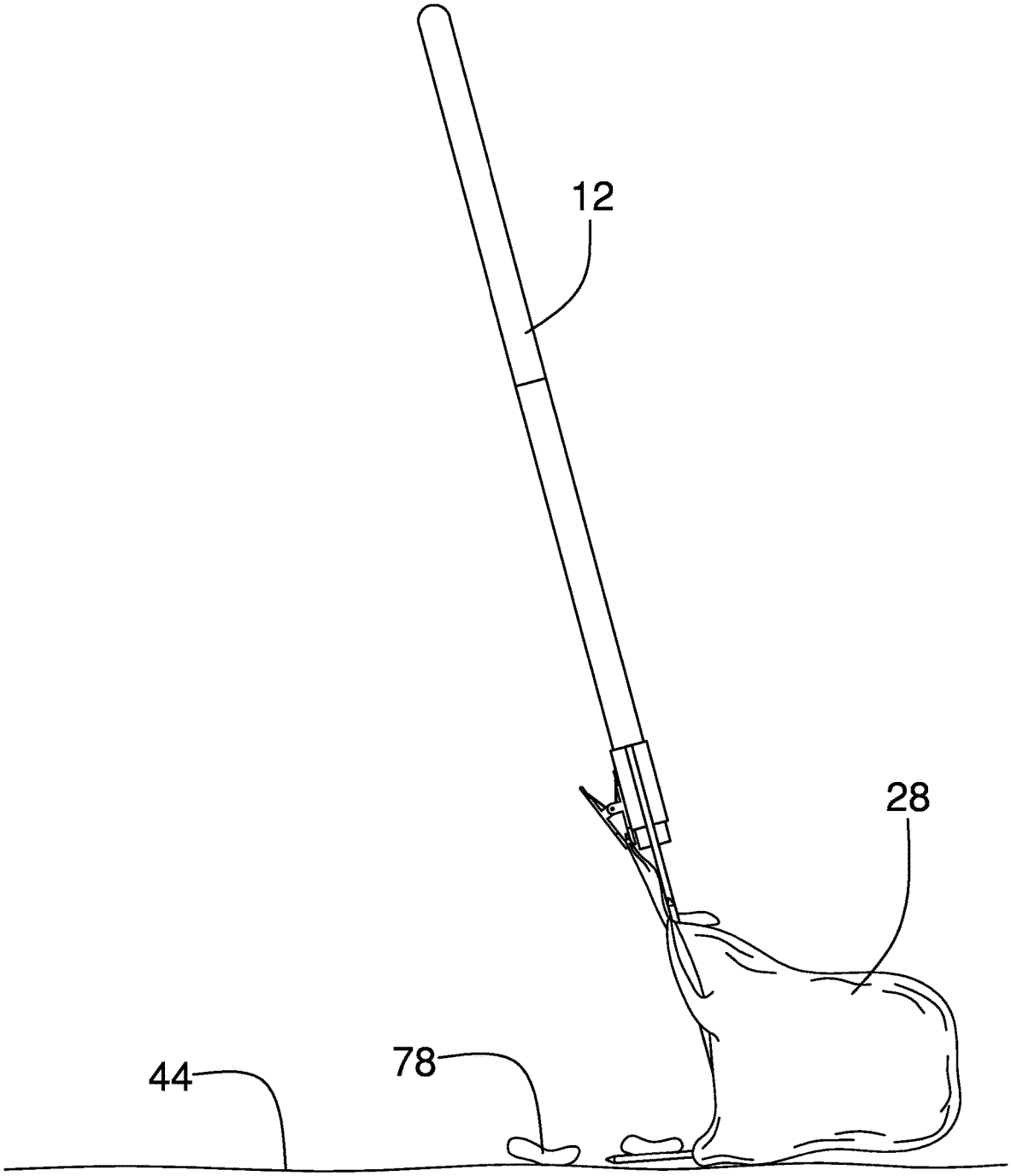
FIG. 8 is a side in-use view of an embodiment of the disclosure.
Figure 9:
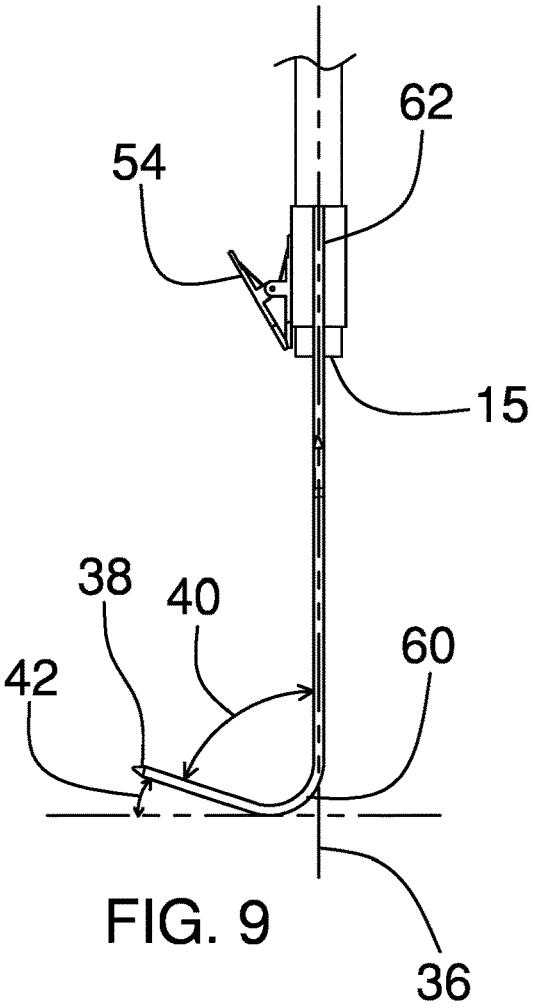
FIG. 9 is a broken side view of an embodiment of the disclosure.
Figure 10:
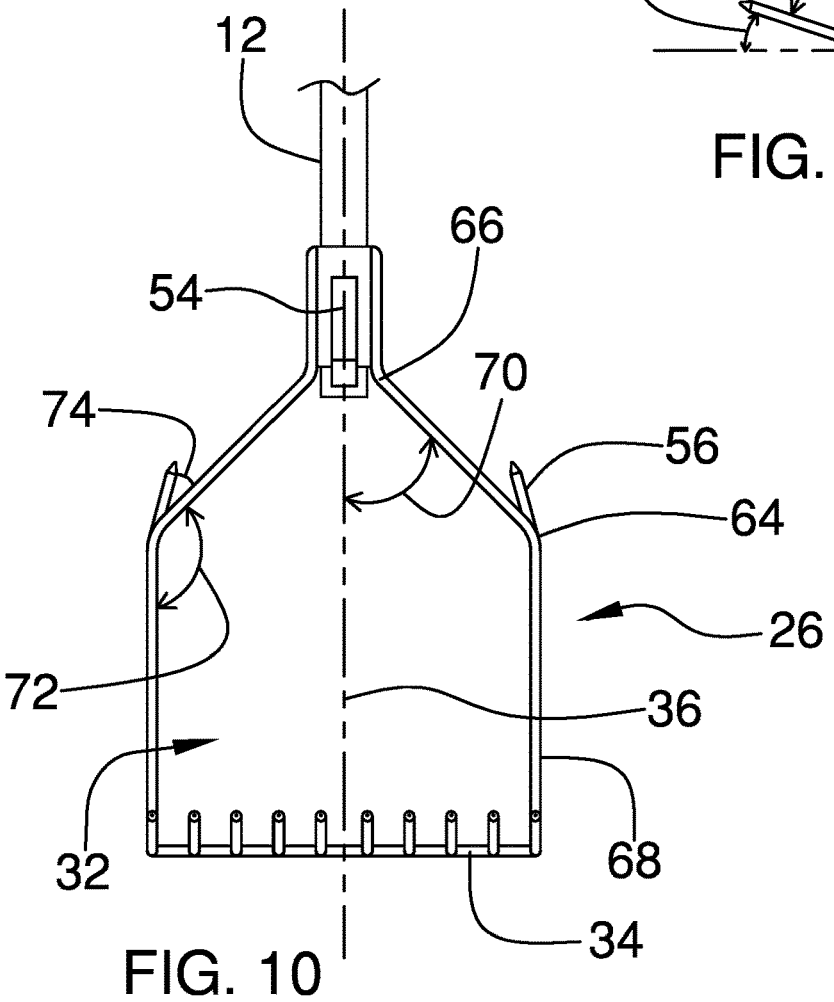
FIG. 10 is a broken front view of an embodiment of the disclosure.

A plurality of tines 38 is attached to and extends away from the end member 34. The tines 38 are co-planar with respect to each other. The tines 38 lay a plane that is angled back toward the pole 12. The plane of the tines forms an angle 40 with respect to the longitudinal axis 36 between 62° and 68° and which more particularly be from 65° to 67°. As can be seen in FIG. 9, this creates an angle 42 of between 22° and 28° with a ground surface 44, wherein angle 42 is most preferably from 23° to 25°. These angles, 40 and 42, facilitate the movement of the tines 38 across a ground surface as shown in FIG. 8 without the tines 38 digging into the ground surface 44. The tines 38 may each extend away from the end member 34 between 1.0 inches and 4.0 inches.

Figure 5:
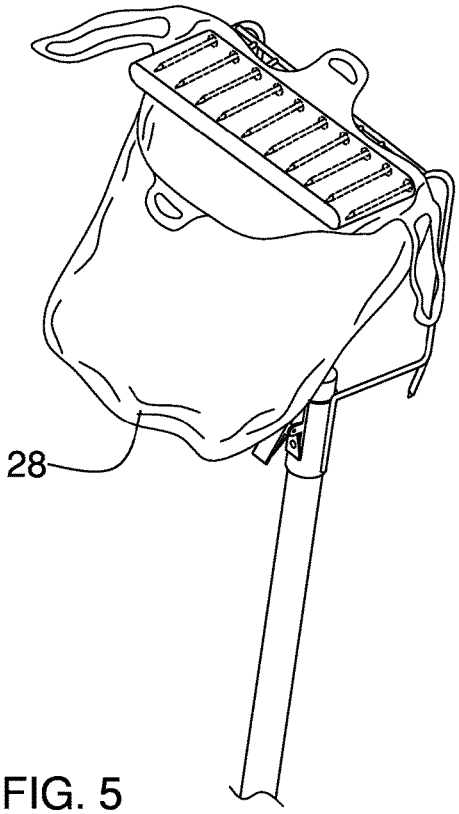
FIG. 5 is a front isometric view of an embodiment of the disclosure.
Figure 6:
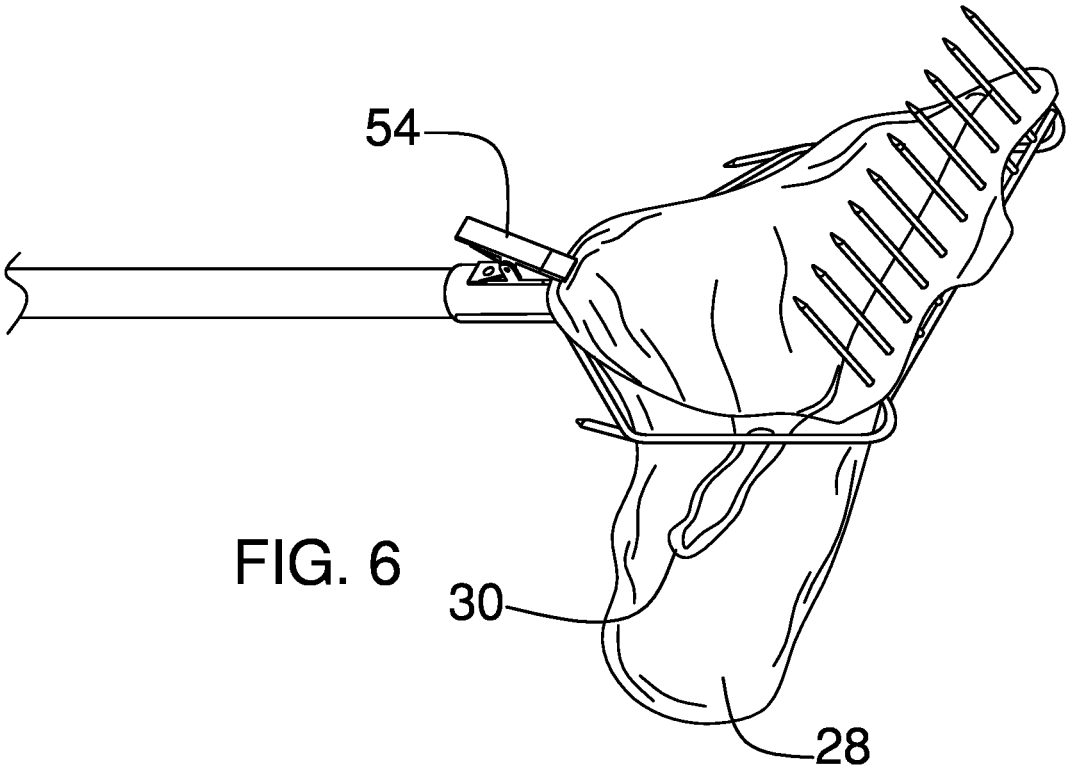
FIG. 6 is a front isometric view of an embodiment of the disclosure.
Figure 7:
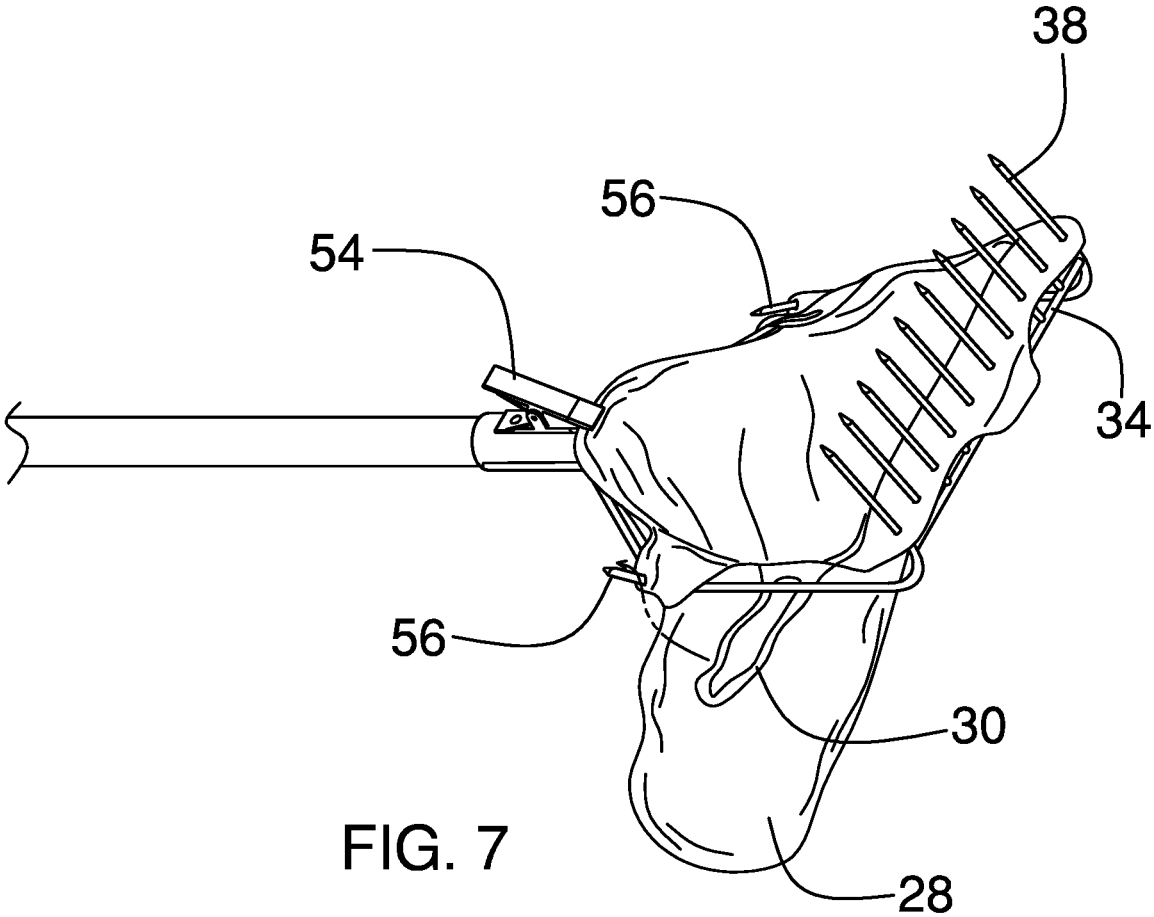
FIG. 7 is a front isometric view of an embodiment of the disclosure.

A receiver 46 is provided and includes a bottom surface 48 having a plurality of wells 50 extending therein. The wells 50 may or may not extend completely through the receiver 46. The wells 50 are aligned with each other and are positioned such that each of the tines 38 is simultaneously extendable into one of the wells 50. The receiver 46 is configured to be urged against the plastic bag 28 when such is positioned between the tines 38 and the receiver 46. The receiver 46 presses against the plastic bag 28 such that the tines 38 impale the plastic bag 28 as shown in FIG. 5. The bottom surface 48 is abuttable against the end member 34 when the tines 38 are fully received by the receiver. The receiver 46 allows for safe mounting of the bag 28 onto the tines 38 while also ensures that a user of the assembly 10 need not touch the tines 38. A securing member 52 is mounted on the receiver 46. The securing member 52 releasably engages the pole 12 to secure the receiver 46 to the pole 12 in a stored condition. The securing member 52 may include a bracket, magnets, snaps, hook and loop fasteners and the like.

A clip 54, which defines an engagement member, is mounted on the pole 12 adjacent to the second end 15. The clip 54 is configured to releasably secure an edge of the plastic bag 28 to the pole 12. The clip 54 may comprise any conventional biased clip member to frictionally engage the plastic bag 28. The clip 54 as shown may be preferred as it includes a fixed plate and a movable plate and therefore can be actuated with a person's thumb.

A pair of spikes 56 is attached to the frame 26. The spikes 56 are positioned on opposite sides of the longitudinal axis 36 with respect to each other. The spikes 56 extend in a direction away from the end member 34 and toward the pole 12. The spikes 56 are configured to pierce and engage the plastic bag 28. The spikes 56 typically have a length between 0.5 inches and 2.0 inches and have pointed free ends. The frame 26, tines 38 and spikes 56 may be comprised of any sufficiently rigid material including plastics and composites, though metals may be preferred for their strength and resistance to breaking.

Figure 2:
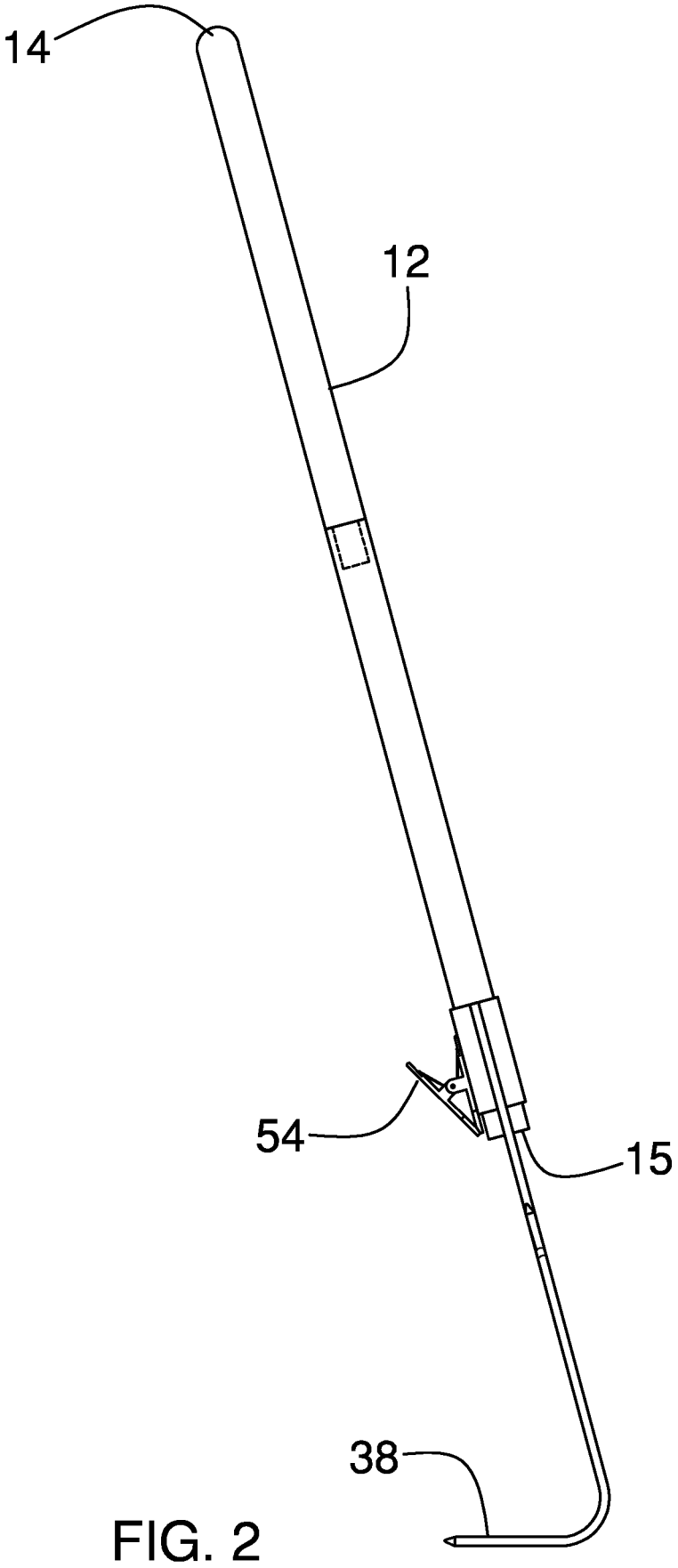
FIG. 2 is a side view of an embodiment of the disclosure.
Figure 3:
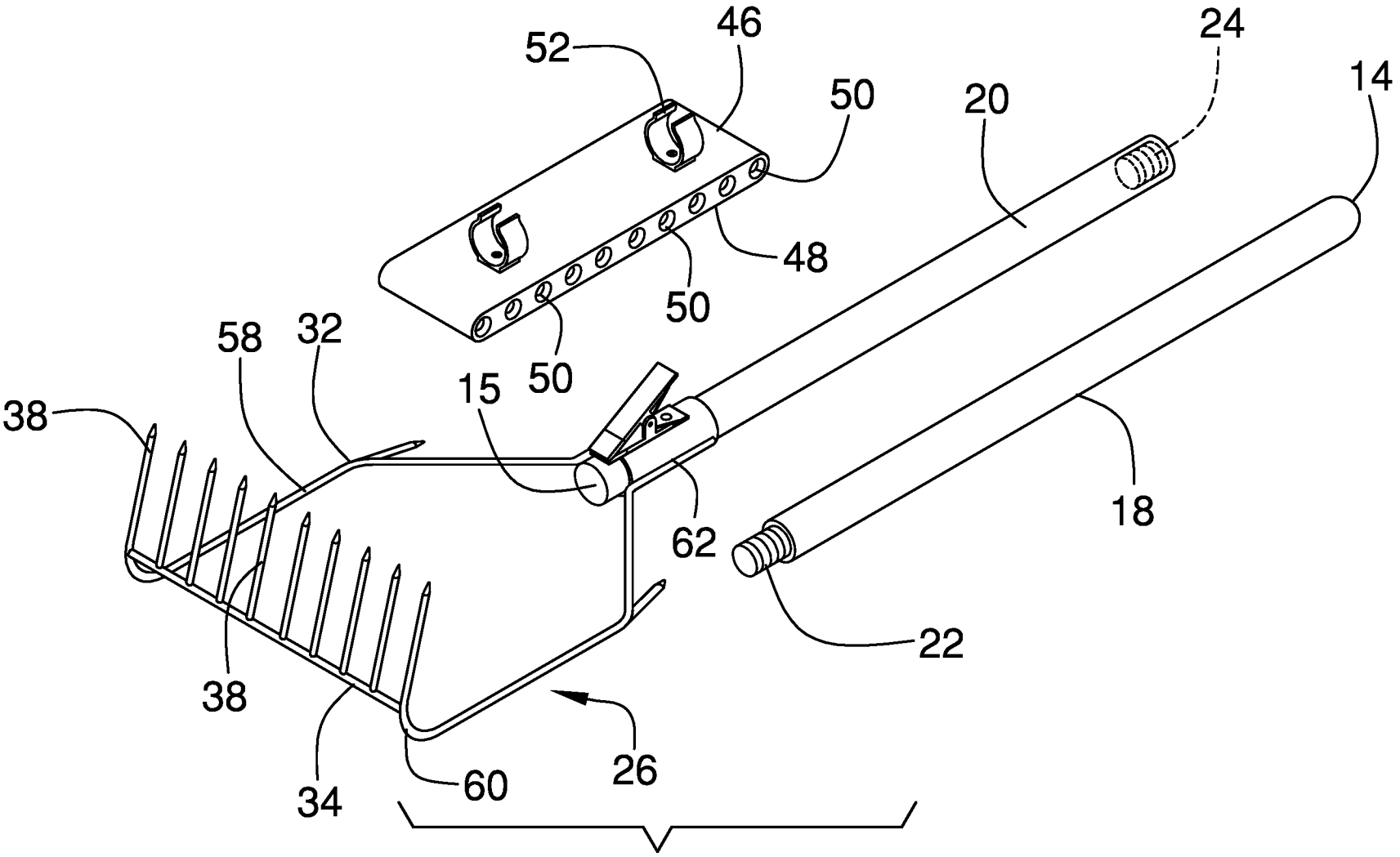
FIG. 3 is a front isometric view of an embodiment of the disclosure.
Figure 4:
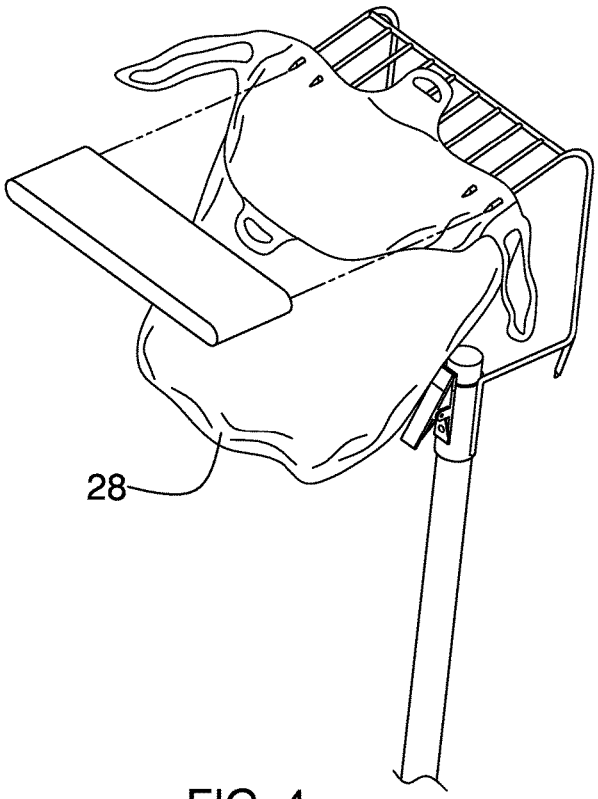
FIG. 4 is a front isometric view of an embodiment of the disclosure.

The frame 26 includes a pair of side arms 58 that is attached to and extends away from the pole 12. Each of the side arms 58 has one of the spikes 56 attached thereto. The side arms 58 each have a distal end 60 and a proximal end 62 relative to the pole 12. The distal ends 60 of each of the side arms 58 are attached to the end member 34. As can be seen in the Figures, the side arms 58 may be extended beyond the end member 34 to form outer ones of the tines 38, though this is not necessary. The side arms 58 are positioned on opposite sides of the pole 12 longitudinal axis 36 relative to each other. Each of the side arms 58 has a bend 64 positioned between the distal end 60 and the proximal end 62 to define a first section 66 including the proximal end 62 and a second section 68 including the distal end 60. The first section 66 extends outwardly away from the pole 12 such an angle 70 formed between the first section 66 and the longitudinal axis 36 is equal to or less than 90° and greater than 30° and is typically between 60° and 35°. The second section 68 forms an inner angle 72 with the first section 66 that is equal to or greater than 90° and less than 150°, and which is typically between 120° and 155°. As can be seen in the figures, the second sections 68 may be orientated parallel to each other. However, it should be understood that each of the side arms 58 may be arcuately shaped from the pole 12 to the end member 34. Each of the spikes 56 is positioned adjacent to a corresponding bend 64 in the side arms 58. The spike 56 forms an acute angle 74 with a respective one of the first sections 66. The distal ends 60 of the side arms 58 are rounded forwardly away from the longitudinal axis 36 as shown in FIGS. 2 and 9 to inhibit the plastic bag 28 from catching on the side arms 58.

Figure 11:
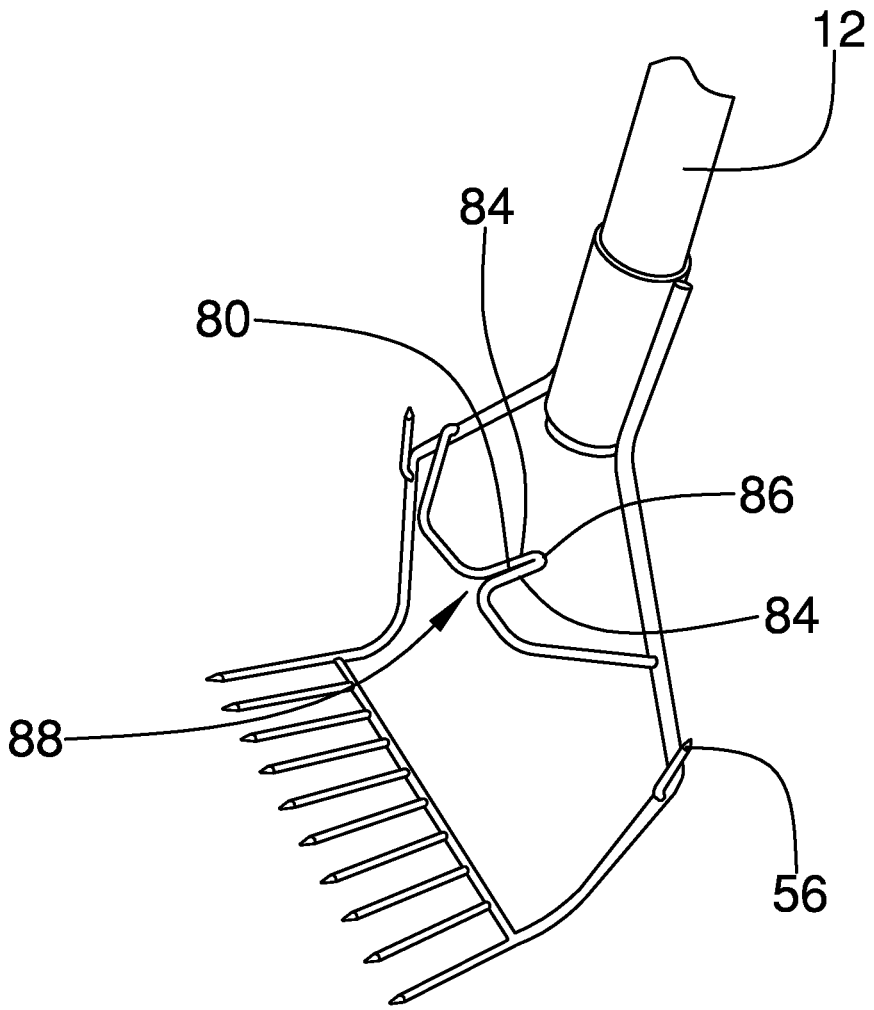
FIG. 11 is a front isometric view of a second embodiment of the disclosure.
Figure 12:
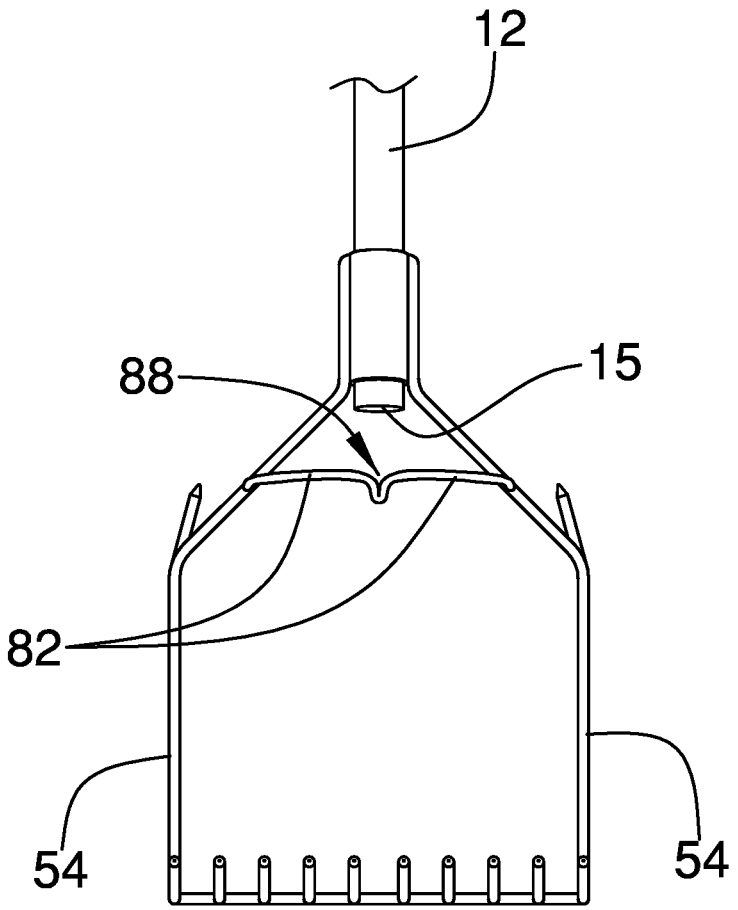
FIG. 12 is a front view of an embodiment of the disclosure as shown in FIG. 11.
Figure 13:
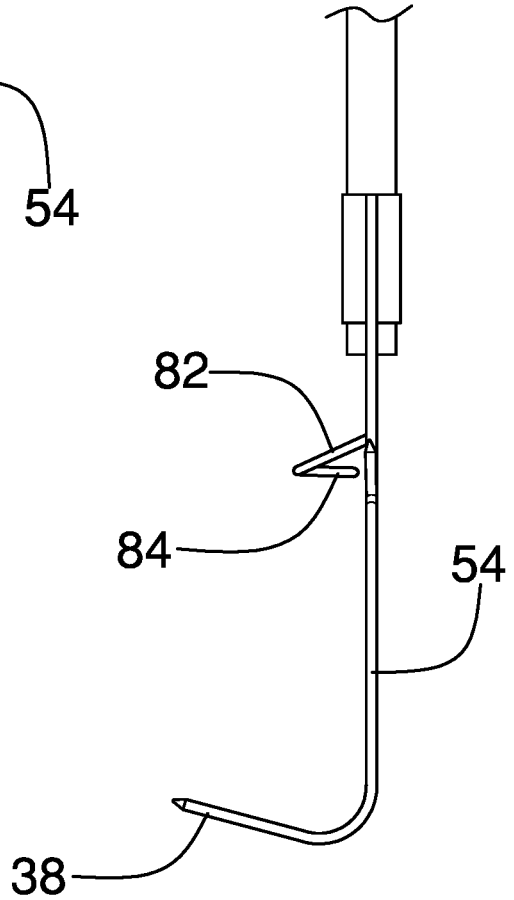
FIG. 13 is a side view of an embodiment of the disclosure as shown in FIG. 11.
Figure 14:
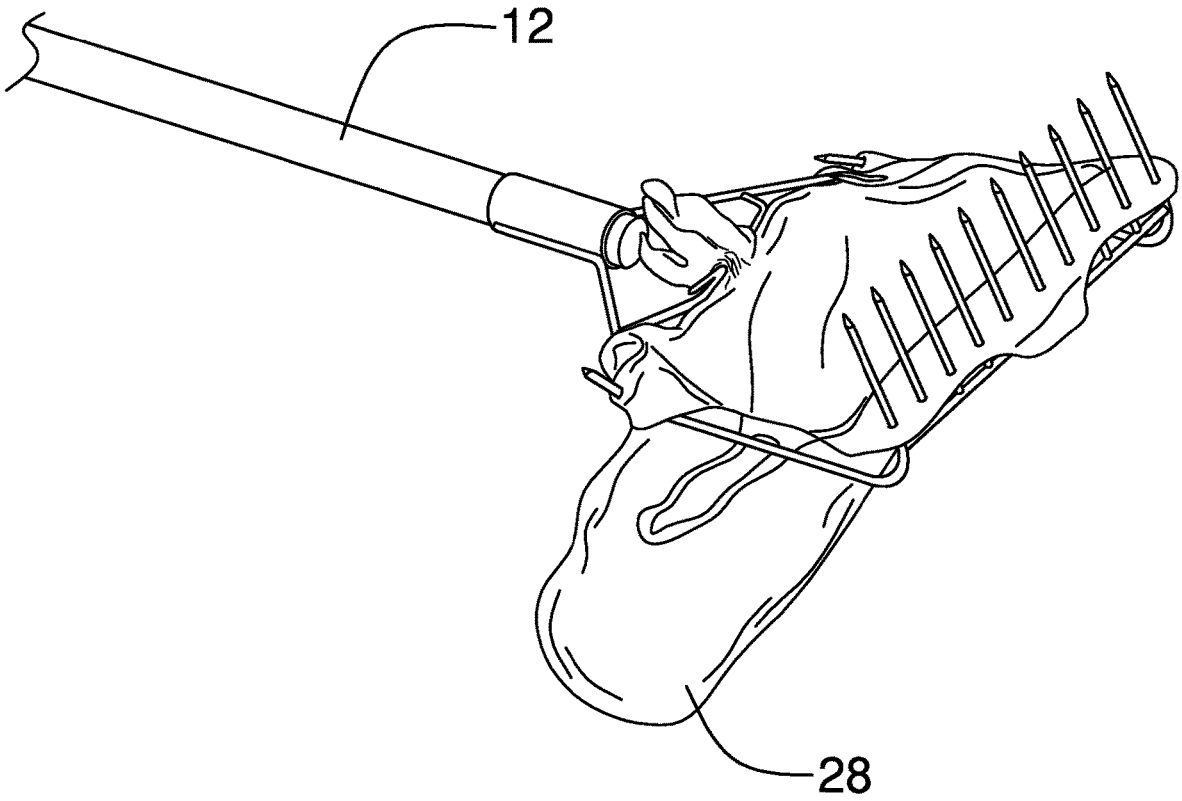
FIG. 14 is a front isometric in-use view of an embodiment of the disclosure as shown in FIG. 11.
Figure 15:
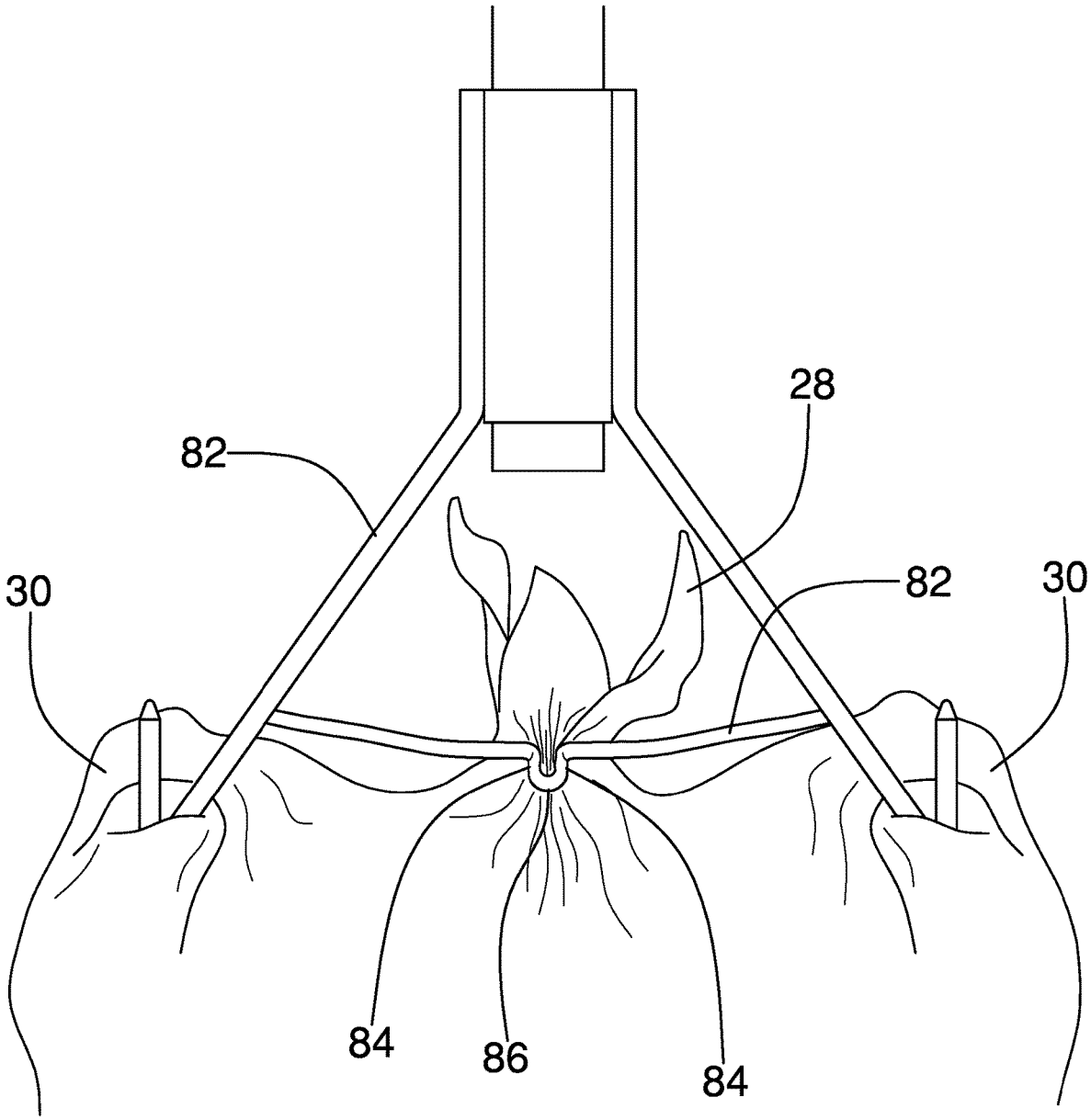
FIG. 15 is a rear in-use view of an embodiment of the disclosure as shown in FIG. 11.

In an embodiment found in FIGS. 11-15 demonstrates that the engagement member may comprise other structures aside from the clip 54. Here, the engagement member comprises a notch 80 formed by a static structure. The term static structure is meant to mean that there is a lack of hinge point or other moving parts as is found in a clip. In this particular embodiment, the notch 80 is located at a convergence of a pair of lateral members 82. The lateral members each include a terminal leg 84 whereby the terminal legs 84 are abutting and orientated parallel to each other to form the notch 80. The terminal legs 84 may be attached to each other at a shared terminal end 86. As can be seen in the FIG. 11, the lateral members 82 may be comprised of a unitary piece of material, such as a metal or plastic material, wherein the lateral members 82 are bent to form the terminal legs 84 and the terminal end 86 is formed by a 180° bend. The notch 80 extends from an entrance 88 of the notch 80 to the terminal end 86. The lateral members 82 are positioned adjacent to second end 15 of the pole 12 and to opposite side arms 54 of the frame 26 to urge together opposite edges of the entrance 88 to create friction at the entrance 88 to the notch 80. As can be seen in FIG. 11, the lateral members 82 may be bent in such a manner to retain tension on the notch 80 and the entrance 88 of the notch may include rounded corners to assist with guiding the plastic bag 28 between the terminal legs 84 as is shown in FIG. 15.

Figure 16:
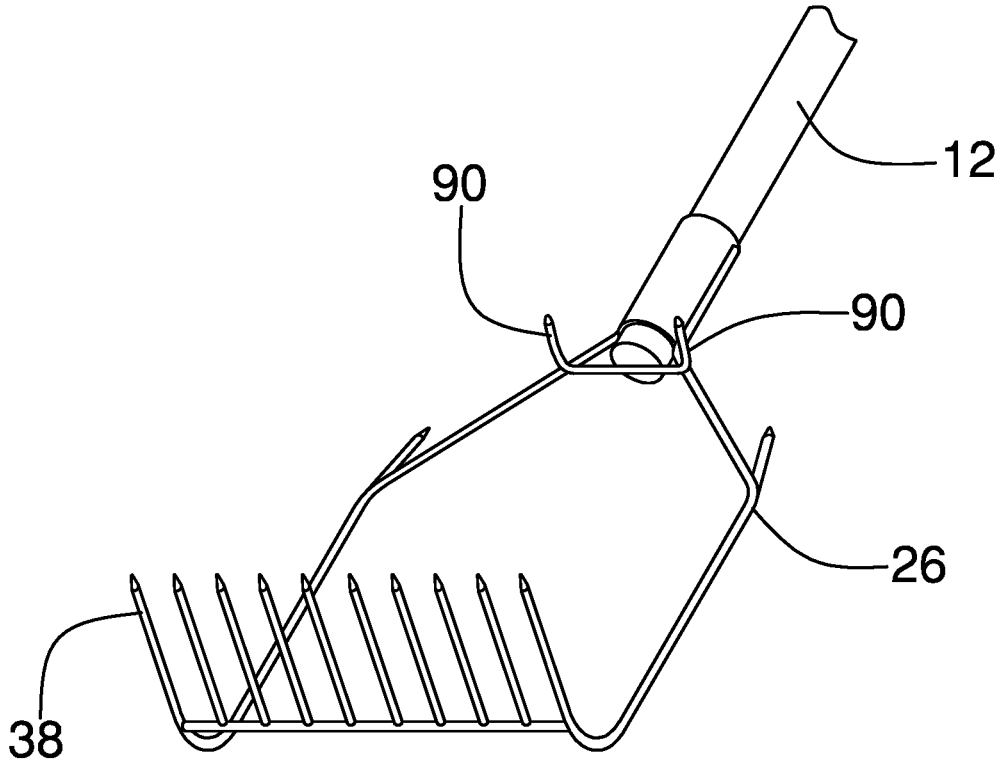
FIG. 16 is a bottom and front isometric view of a third embodiment of the disclosure.
Figure 17:
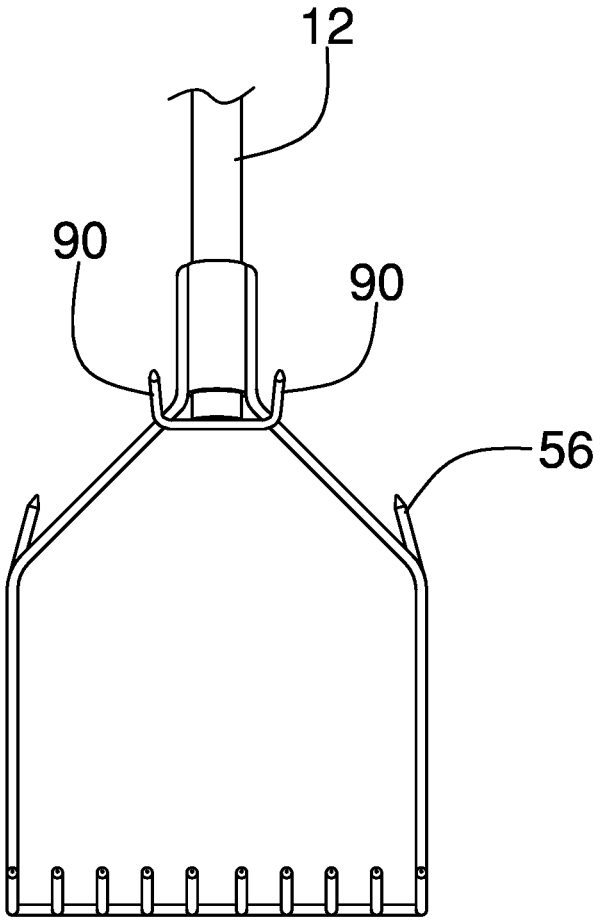
FIG. 17 is a front view of the third embodiment of the disclosure.
Figure 18:
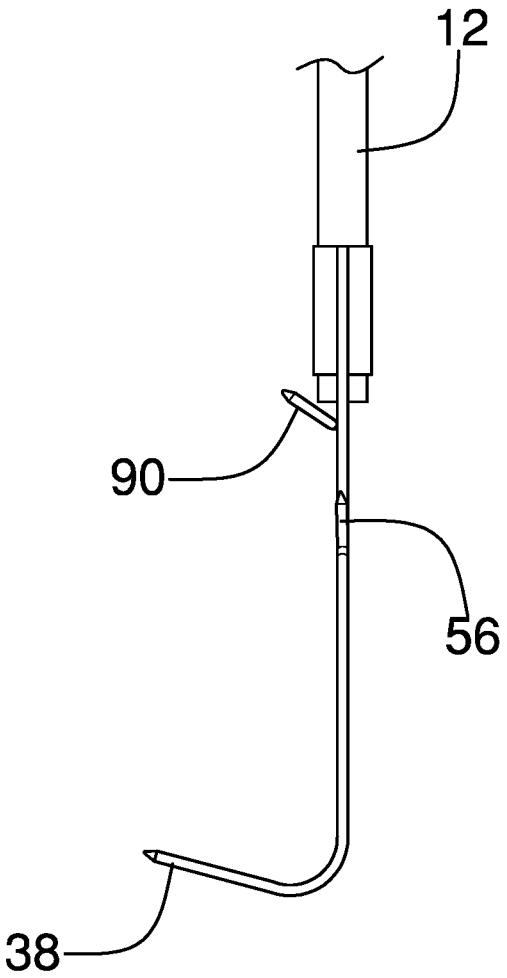
FIG. 18 is a side view of the third embodiment of the disclosure.

The embodiment of FIGS. 16-18 includes an engagement member utilizing one or more stakes 90, attached to the frame 26 adjacent to the second end 15 of the pole 12, and angled forward of the frame 26 to puncture the plastic bag 28 and retain it in place on the frame 26. As can be seen best in FIG. 18 the stakes 90 may be angled backward, or toward the pole 12, to help retain the plastic bag 28 on the frame 26.

In use, the plastic bag 28 is positioned adjacent to the frame 26 such that plastic bag 28 is positioned between the tines 38 and the receiver 46. The receiver 46 is aligned with the tines 38 and is urged against the plastic bag 28 such that the tines 38 impale the plastic bag 28. The bag 28 is then pushed through the closed loop 32 formed by the frame 26. An opposite edge of the bag 28 is secured with the clip 54, or engagement member. The plastic bag 28 is orientated such that its handles 30 extend laterally away from the frame 26. The spikes 56 are then extended through the plastic bag 28 and the handles 30 may be wrapped around an adjacent spike 56. The tines 38 are then moved across the ground surface 44 to engage and capture animal waste 78 positioned on the ground surface 44 such that the animal waste 78 moves into the plastic bag 28. The user then removes the plastic bag 28 from the spikes 56 and then the tines 38 by gripping the handle 38 or edges of the plastic bag 28 and pulling the plastic bag 28 away from the frame 26. This action also removes any animal waste from the tines 38 as the plastic bag 28 slides along the tines 38. As the handles 30 are gripped, the clip 54 is opened to remove the plastic bag 28 completely from the assembly 10 such that it may be discarded.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An animal waste collection assembly configured to collect animal waste in a plastic bag, the assembly comprising:

a pole defining a handle, the pole being elongated and having a first end and a second end;

a frame configured to releasably engage and support a plastic bag, the frame including a closed loop being attached to and extending away from the second end of the pole, the closed loop having an end member positioned opposite of the pole, the end member being linear for a distance greater than 4.0 inches and being orientated perpendicular to a longitudinal axis of the pole;

a plurality of tines being attached to and extending away from the end member, the tines being co-planar with respect to each other, the tines lying a plane;

an engagement member being mounted adjacent to the second end of the pole, the engagement member being configured to releasably secure the plastic bag adjacent to the pole to retain the plastic bag in an open configuration; and a receiver including a bottom surface having a plurality of wells extending therein, the wells being aligned with each other and being positioned such that each of the tines is simultaneously extendable into one of the wells, wherein the receiver is configured to be urged against the plastic bag positioned between the tines and the receiver such that the tines impale the plastic bag.

2. The animal waste collection assembly according to claim 1, wherein the plane of the tines is angled back toward the pole.

3. The animal waste collection assembly according to claim 2, wherein the plane forms an angle with respect to the longitudinal axis between 62° and 68°.

4. The animal waste collection assembly according to claim 1, wherein the bottom surface is abuttable against the end member when the tines are fully received by the receiver.

5. The animal waste collection assembly according to claim 1, further including a securing member being mounted on the receiver, the securing member releasably engaging the pole to secure the receiver to the pole.

6. The animal waste collection assembly according to claim 1, further including a pair of spikes being attached to the frame, the spikes being positioned on opposite sides of the longitudinal axis with respect to each other, the spikes extending toward the pole, the spikes being configured to pierce and engage the plastic bag.

7. The animal waste collection assembly according to claim 6, wherein the spikes have a length between 0.5 inches and 2.0 inches.

8. The animal waste collection assembly according to claim 6, wherein the frame includes:

a pair of side arms being attached to and extending away from the pole, each of the side arms having one of the spikes attached thereto, the side arms each having a distal end and a proximal end relative to the pole, the distal ends of each of the side arms being attached to the end member, the side arms being positioned on opposite sides of the longitudinal axis relative to each other, each of the side arms having:

a bend positioned between the distal end and the proximal end to define a first section including the proximal end and a second section including the distal end, the first section extending outwardly away from the pole such an angle formed between the first section and the longitudinal axis being equal to or less than 90° and greater than 30°; and the second section forming an inner angle with the first section being equal to or greater than 90° and less than 150°.

9. The animal waste collection assembly according to claim 8, wherein each of the spikes being positioned adjacent to a corresponding bend in the side arms, each said spike forming an acute angle with a respective one of the first sections.

10. The animal waste collection assembly according to claim 9, wherein the plane of the tines is angled back toward the pole.

11. The animal waste collection assembly according to claim 10, wherein the plane forms an angle with respect to the longitudinal axis between 62° and 68°.

* * * * *